US006231321B1

(12) United States Patent
Fukudome et al.

(10) Patent No.: US 6,231,321 B1
(45) Date of Patent: May 15, 2001

(54) AIR COMPRESSOR

(75) Inventors: Hiroshi Fukudome; Yoichi Mizutani, both of Kanagawa-ken; Kan Kobayashi, Tokyo, all of (JP)

(73) Assignee: Tokico Ltd., Kanagawa-ken (JP)

( * ) Notice: Subject to any disclaimer, the term of this patent is extended or adjusted under 35 U.S.C. 154(b) by 0 days.

(21) Appl. No.: 09/362,730

(22) Filed: Jul. 29, 1999

(30) Foreign Application Priority Data

Jul. 31, 1998 (JP) ..... 10-230307
Jun. 11, 1999 (JP) ..... 11-165859

(51) Int. Cl.[7] ..... F04B 23/00
(52) U.S. Cl. ..... 417/502; 137/624.11; 137/627.5
(58) Field of Search ..... 417/502, 504, 417/307, 308, 440; 137/624.11, 115.14, 625.34, 627.5; 280/6.157

(56) References Cited

U.S. PATENT DOCUMENTS 3,613,711 * 10/1971 Wilke ..... 137/115.14
5,010,923 * 4/1991 Kouda et al. ..... 137/625.34
5,466,007 * 11/1995 Smith ..... 280/6.157
5,927,327 * 7/1999 Bezos et al. ..... 137/624.11
6,082,406 * 7/2000 Williamson, Jr. et al. ..... 137/627.5

* cited by examiner

*Primary Examiner*—Teresa Walberg
*Assistant Examiner*—Quang Van
(74) *Attorney, Agent, or Firm*—Wenderoth, Lind & Ponack, L.L.P.

(57) ABSTRACT

This invention pertains to an air compressor having a cylinder head with an air supply passage communicating with a discharge hole. First and second exhaust passages are arranged in parallel between the air supply passage and an exhaust port. A pilot-operated switching valve is located at an intermediate position in the first exhaust passage. A solenoid-operated exhaust valve is located at an intermediate position in the second exhaust passage. The solenoid-operated exhaust valve is selectively opened or closed by an externally supplied electric current, thereby controlling a pilot pressure applied to a valving element of the pilot-operated switching valve. The valving element is rested on or separated from a valve seat by the pilot pressure. The compressed air discharge speed can be increased without increasing the size of the cylinder head, and vehicle height adjustment, for example, can be made in a reduced period of time.

12 Claims, 8 Drawing Sheets

AIR COMPRESSOR

BACKGROUND OF THE INVENTION

The present invention relates to an air compressor for use in a vehicle, for example. More particularly, the present invention relates to an air compressor suitably used to supply and discharge compressed air for vehicle height adjustment with respect to an air-suspension system or the like that constitutes a vehicle-height adjusting apparatus.

In general, an air-suspension system mounted on a vehicle as a vehicle-height adjusting apparatus is selectively supplied with or exhausted of compressed air from an air compressor to suppress changes in the vehicle height that may occur according to the vehicle weight or the like and to allow vehicle height adjustment to be made as the driver likes.

A vehicle-mounted air compressor used for an air-suspension system or the like has a cylinder and a piston reciprocally provided in the cylinder to compress air in the cylinder. The air compressor further has a cylinder head mounted on the cylinder. The cylinder head is provided with an air supply passage for supplying compressed air generated by the piston to a pneumatic apparatus such as an air-suspension system. In addition, an exhaust valve is provided in the cylinder head to discharge compressed air from the air supply passage to an exterior of the cylinder head [for example, see Japanese Patent Application Unexamined Publication (KOKAI) No. 2-141321 (1990)].

In this type of conventional air compressor, when compressed air is to be supplied to an air-suspension system, for example, the piston is caused to reciprocate in the cylinder with the exhaust valve closed in advance, thereby generating compressed air and supplying it to the air-suspension system through the air supply passage. In the air-suspension system, an air chamber is expanded by the compressed air supplied thereto, and thus vehicle height adjustment is made so as to raise the vehicle height.

During vehicle height adjustment for lowering the vehicle, the exhaust valve is opened, with the piston reciprocating motion in the cylinder stopped, to allow the air supply passage to communicate with the exterior of the cylinder head, thereby making compressed air flow backward from the air chamber of the air-suspension system into the air supply passage. Thus, the compressed air is discharged to the exterior of the cylinder head to contract the air chamber.

In the conventional air compressor, the cylinder head is provided with a single exhaust passage for allowing the air supply passage to communicate with the outside air, and a solenoid-operated exhaust valve that constitutes the exhaust valve is placed at an intermediate position in the exhaust passage. The solenoid-operated exhaust valve is a normally closed valve. Accordingly, the solenoid-operated exhaust valve opens the exhaust passage only when it is opened by externally supplying an electric current thereto, and permits compressed air to be discharged from the air supply passage to the exterior of the cylinder head.

Incidentally, the above-described conventional air compressor is merely arranged such that a single exhaust passage is provided in the cylinder head and the exhaust passage is selectively opened or closed by the solenoid-operated exhaust valve. Therefore, when compressed air in the air-suspension system is discharged to the exterior of the cylinder head to adjust the vehicle height to a lower level, the flow rate of compressed air to be discharged is undesirably limited by the single exhaust passage. Consequently, the compressed air discharge speed is unfavorably low. Therefore, it is difficult to perform vehicle height adjustment in a short period of time.

It is possible to take measures to increase the compressed air discharge speed, for example, by increasing the port diameter of the solenoid-operated exhaust valve. However, if the port diameter of the solenoid-operated exhaust valve is increased, the pressure-receiving area of the valving element with respect to the exhaust port becomes large. Therefore, it becomes necessary to increase the urging force of a valve spring for urging the valving element of the solenoid-operated exhaust valve in a valve closing direction and also necessary to increase the size of a solenoid (coil) for driving the valving element in a valve opening direction against the valve spring. Consequently, not only the solenoid-operated exhaust valve but also the cylinder head must be increased in size.

SUMMARY OF THE INVENTION

In view of the above-described problems associated with the prior art, an object of the present invention is to provide an air compressor designed so that the compressed air discharge speed can be increased without increasing the size of a passage member, e.g. a cylinder head, and therefore, vehicle height adjustment, for example, can be made in a reduced period of time, and further the whole air compressor can be formed in a compact structure.

The present invention is applied to an air compressor having a drive source and a compressed air generating mechanism driven by the drive source to generate compressed air. A passage member is connected to the compressed air generating mechanism. The passage member is provided with an air supply passage for supplying the compressed air to a pneumatic apparatus. In addition, an exhaust device is provided in the passage member to discharge compressed air from the pneumatic apparatus to the exterior of the cylinder head, According to the present invention, the exhaust device includes first and second exhaust passages provided in the passage member and connected to the air supply passage in parallel to each other. A pilot-operated switching valve is provided in the first exhaust passage and supplied with compressed air from the air supply passage as a pilot pressure, thereby selectively bringing the first exhaust passage into or out of communication with the exterior of the cylinder head. In addition, a solenoid-operated exhaust valve is provided in the second exhaust passage to selectively bring the second exhaust passage into or out of communication with the exterior of the cylinder head and also to control the pilot pressure supplied to the pilot-operated switching valve in response to external supply of an electric current.

With the above-described arrangement, when the solenoid-operated exhaust valve is closed by stopping the external supply of an electric current, for example, the second exhaust passage is cut off from the outside or atmospheric air (i.e. the air that is exterior of the passage member), and compressed air from the air supply passage is supplied to the switching valve acting in a valve closing direction. Thus, the first exhaust passage can be kept cut off from the outside air by the pilot-operated switching valve.

When the solenoid-operated exhaust valve is opened by externally supplying an electric current thereto, the second exhaust passage is allowed to communicate with the outside air. In addition, the pilot-operated switching valve is supplied with a pilot pressure acting in a valve opening direction. By opening the switching valve with the pilot pressure, the first exhaust passage is allowed to communicate with the outside air.

According to a specific example of the present invention, the pilot-operated switching valve includes a valving element slide hole formed as a stepped hole that is provided in the passage member at an intermediate position in the first exhaust passage. The valving element slide hole has a small-diameter hole portion, a large-diameter hole portion, and an annular step portion formed between the small-diameter hole portion and the large-diameter hole portion. A stepped valving element is fitted in the valving element slide hole. The stepped valving element defines an annular pressure-receiving chamber between the stepped valving element and the annular step portion. An urging device is provided between the stepped valving element and the passage member to urge the stepped valving element in a direction in which the pressure-receiving chamber contracts, thereby holding the stepped valving element in a valve closing position. Normally, the solenoid-operated exhaust valve allows a pilot passage communicating with the pressure-receiving chamber to open to the atmospheric air. When excited with an externally supplied electric current, the solenoid-operated exhaust valve introduces compressed air from the air supply passage into the pilot passage as a pilot pressure.

By virtue of the above-described arrangement, when the annular pressure-receiving chamber of the pilot-operated switching valve is open to the atmospheric air through the solenoid-operated exhaust valve, the stepped valving element is held in the valve closing position by the urging device. Thus, the first exhaust passage can be kept cut off from the outside air. When the solenoid-operated exhaust valve is excited, compressed air from the air supply passage is introduced into the pilot passage as a pilot pressure. Therefore, by supplying the pilot pressure to the annular pressure-receiving chamber, the stepped valving element of the pilot-operated switching valve can be opened against the urging device. Accordingly, the first exhaust passage is allowed to communicated with the outside air, and compressed air in the air supply passage can be discharged to the exterior of the passage member.

DETAILED DESCRIPTION OF THE INVENTION

Figure 1:
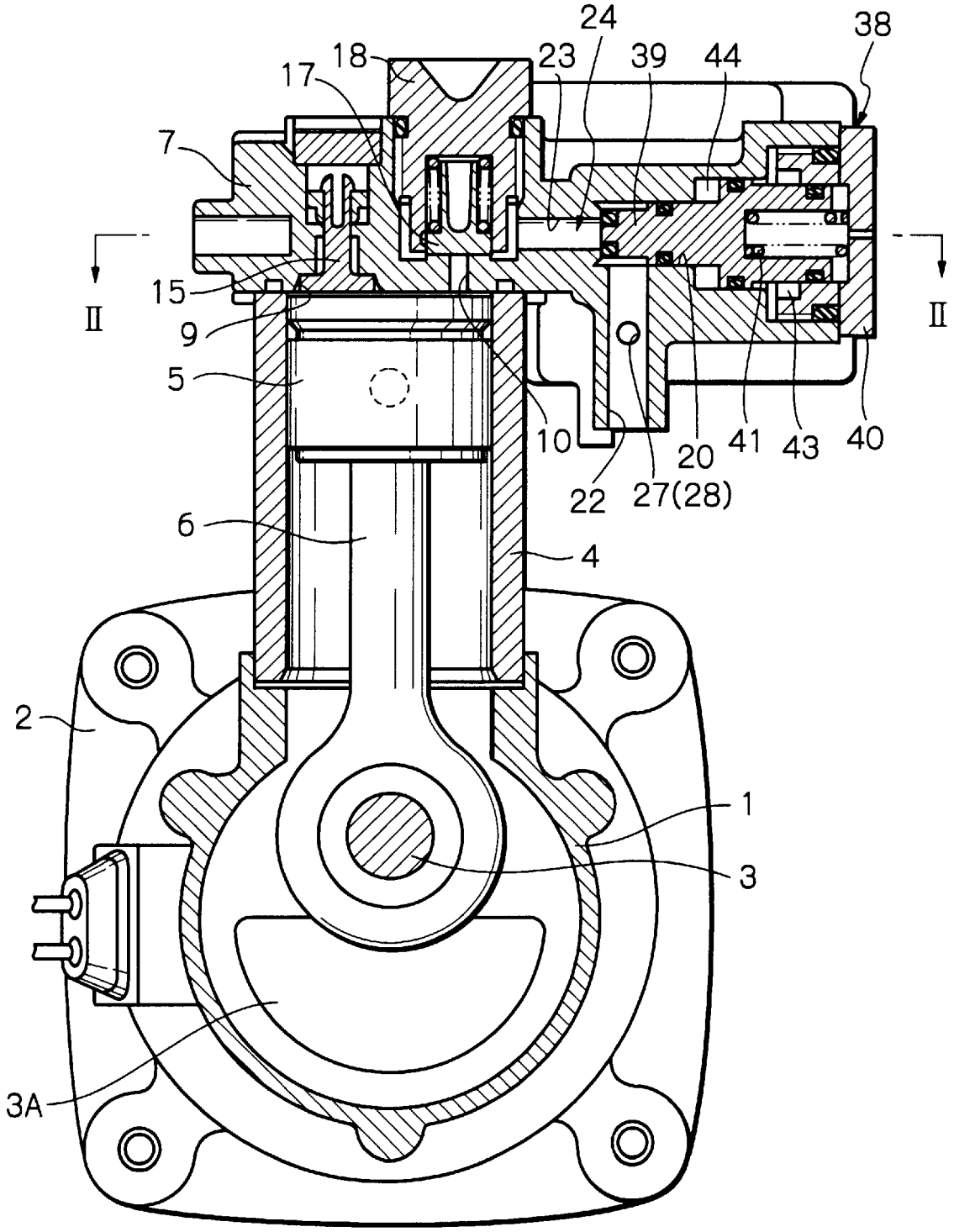
FIG. 1 is a vertical sectional view of an air compressor according to a first embodiment of the present invention.

Air compressors according to embodiments of the present invention will be described below in detail with reference to the accompanying drawings. In the following embodiments, the present invention is applied to a reciprocating air compressor for use in a vehicle, by way of example.

FIGS. 1 to 4 show a first embodiment of the present invention. In the figures, a crank case 1 is integrated with a motor casing 2 containing an electric motor (not shown) as a drive source. A crankshaft 3 is rotatably provided in the crank case 1. The crankshaft 3 is rotatively driven by the electric motor. It should be noted that the crankshaft 3 is provided with a balance weight 3A. The balance weight 3A is adapted to give rotational balance to the crankshaft 3.

A cylinder 4 is mounted on the crank case 1. A piston 5 is slidably fitted in the cylinder 4. The piston 5 is connected to the crankshaft 3 through a connecting rod 6 to reciprocate vertically in the cylinder 4. The piston 5 generates compressed air in a compression chamber in the cylinder 4 and thus constitutes a compressed air generating mechanism in combination with the cylinder 4 and so forth.

Figure 2:
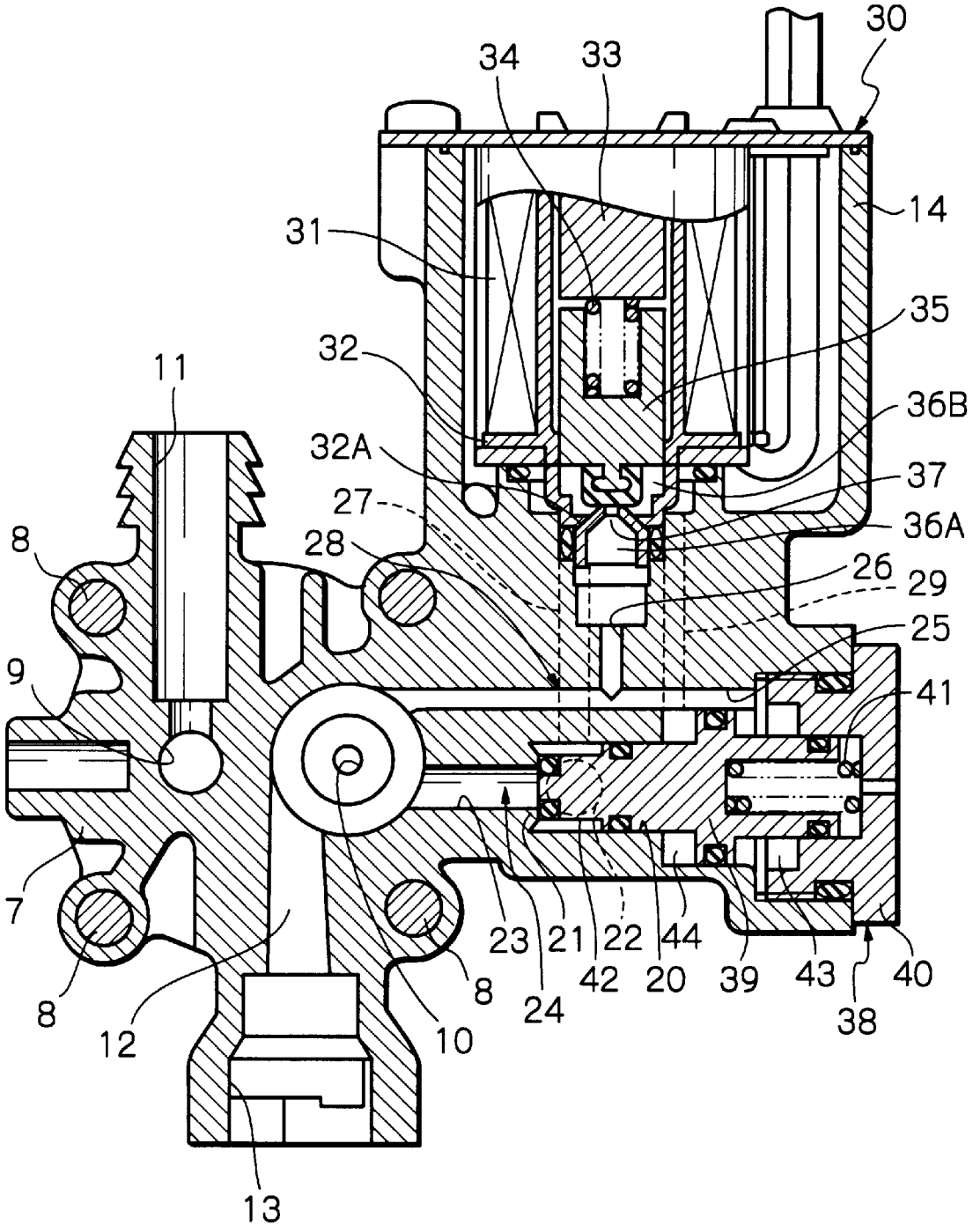
FIG. 2 is an enlarged sectional view as seen from the direction of the arrow II—II in FIG. 1, showing a solenoid-operated exhaust valve and a pilot-operated switching valve, provided in a cylinder head.
Figure 3:
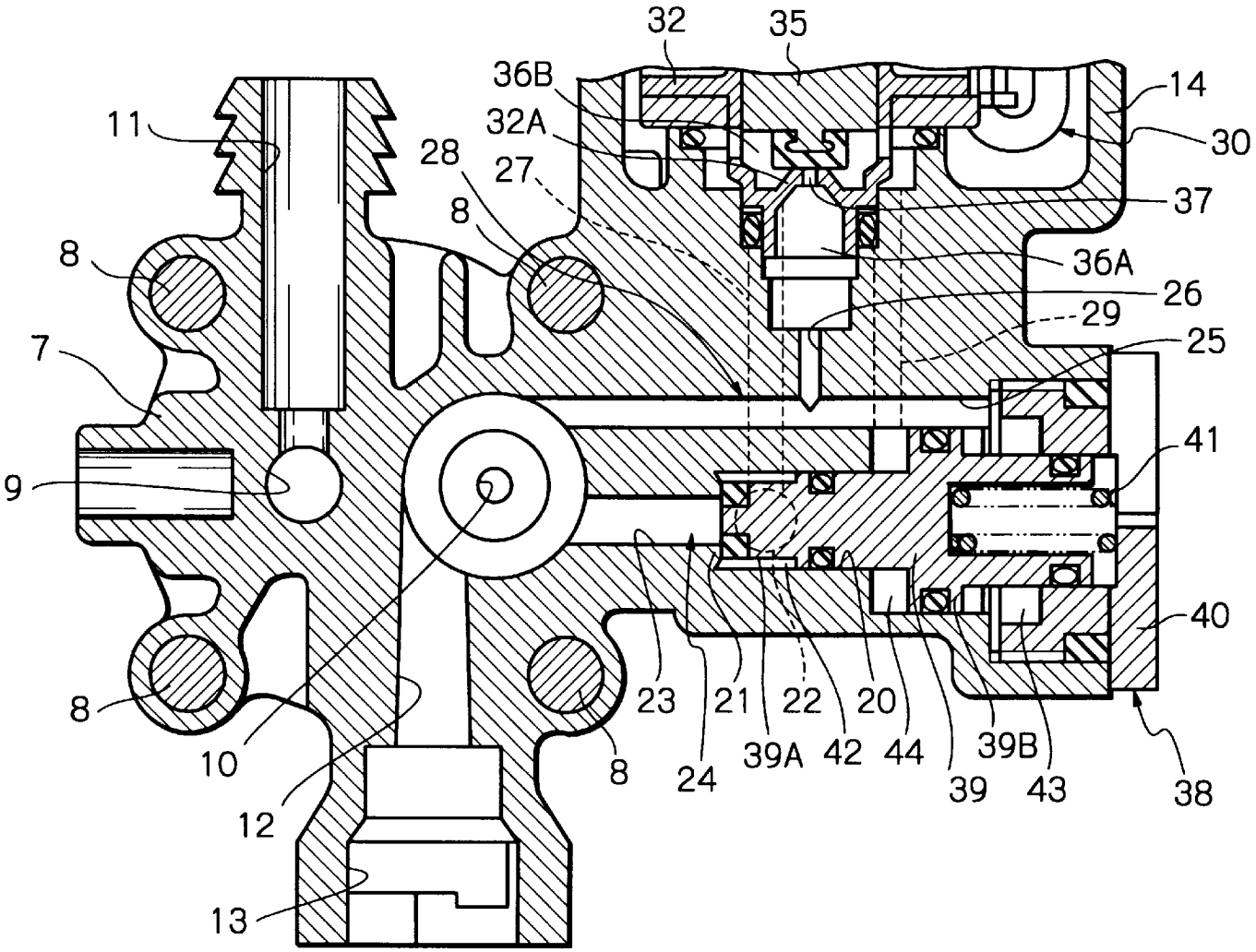
FIG. 3 is an enlarged view of an essential part of the arrangement in FIG. 2, showing first and second exhaust passages.

A cylinder head 7 is mounted on the cylinder 4 and secured thereto with bolts 8 to serve as a passage member. As shown in FIGS. 2 and 3, the cylinder head 7 is provided with a suction hole 9 and a discharge hole 10, which communicate with the inside of the cylinder 4. The cylinder head 7 is further provided with a suction port 11 extending in the radial direction of the suction hole 9 and a discharge port 13 extending in the tangential direction of the discharge hole 10 to constitute an air supply passage 12 in combination with the discharge hole 10. Furthermore, the cylinder head 7 is provided with exhaust passages 24 and 28 (described later).

As shown in FIG. 2, the cylinder head 7 is integrally provided with a valve-accommodating cylinder 14 projecting in the opposite direction to the direction in which the discharge port 13 opens. The valve-accommodating cylinder 14 is formed in the shape of a cylindrical member, one end of which is closed and which has a relatively large diameter. A solenoid-operated exhaust valve 30 (described later) is accommodated in the valve-accommodating cylinder 14.

Figure 4:
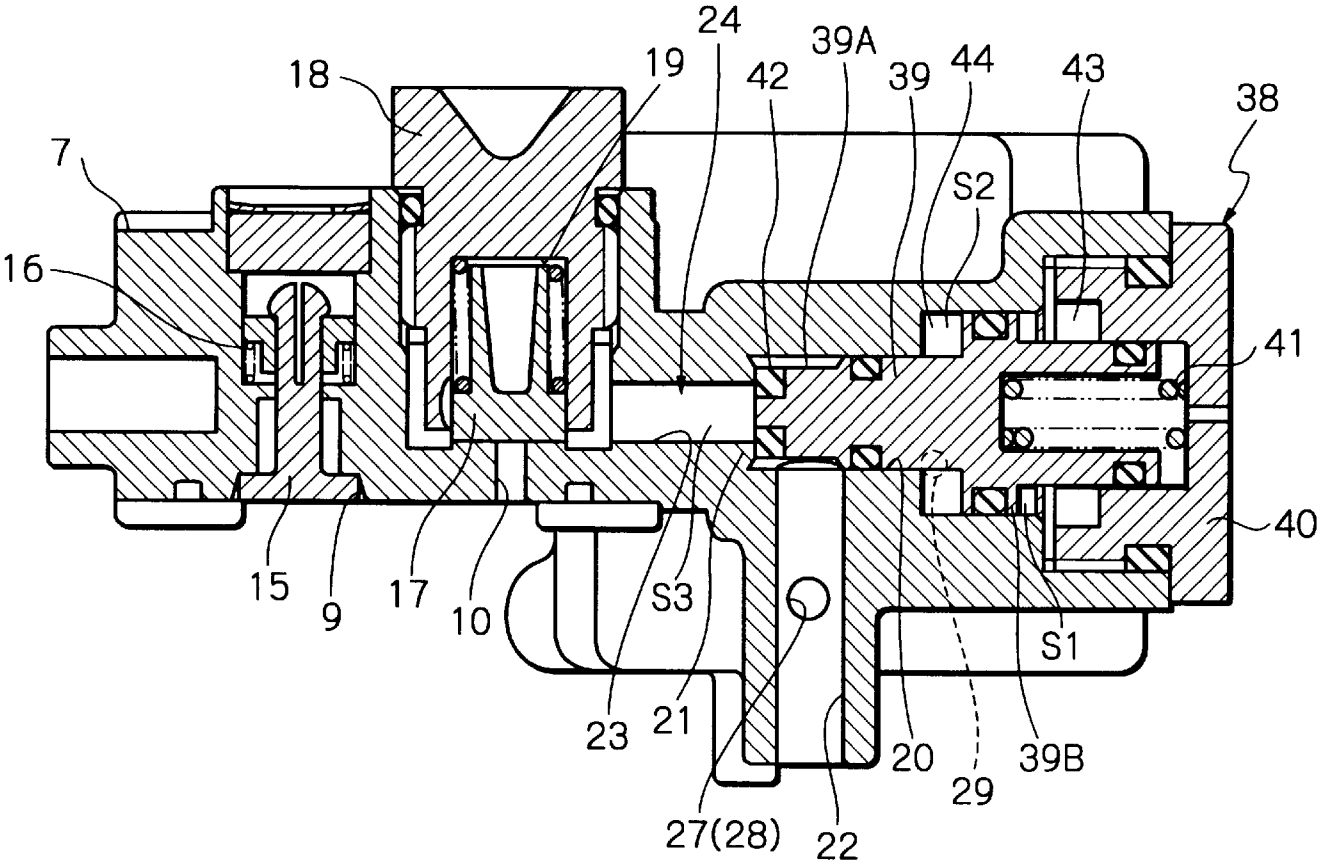
FIG. 4 is an enlarged sectional view showing a cylinder head, a suction valve, and a discharge valve, a pilot-operated switching valve of FIG. 1.

A suction valve 15 selectively opens or closes the suction hole 9. As shown in FIG. 4, the suction valve 15 is constantly urged in the valve closing direction by a valve spring 16. During the suction stroke of the piston 5, the suction valve 15 opens the suction hole 9 against the valve spring 16, thereby allowing the outside air to be sucked into the cylinder 4 from the suction port 11 through the suction hole 9.

A discharge valve 17 selectively opens or closes the discharge hole 10. A cylindrical guide 18 liftably retains the discharge valve 17. As shown in FIG. 4, the cylindrical guide 18 is formed in the shape of a cylinder, one end of which is closed. The cylindrical guide 18 accommodates the discharge valve 17 together with a valve spring 19. The cylindrical guide 18 is screwed into the cylinder head 7 from above the discharge valve 17. Thus, the discharge valve 17 is constantly urged in the valve closing direction by the valve spring 19. It should be noted that in FIGS. 2 and 3 the illustration of the suction valve 15 and the discharge valve 17 is omitted in order to clearly show the suction hole 9 and the discharge hole 10.

A valving element slide hole 20 is provided in the cylinder head 7. As shown in FIGS. 2 to 4, the valving element slide hole 20 is situated opposite to the suction hole 9 across the discharge hole 10. The valving element slide hole 20 is formed in the shape of a stepped hole extending approximately horizontally and opening to the exterior of the cylinder head 7". The valving element slide hole 20 constitutes a part of a pilot-operated switching valve 38 (described later). A valve seat 21 is formed in the valving element slide hole 20 on the end surface side thereof. A valving element 39 (described later) selectively rests on or separates from the valve seat 21.

An exhaust port 22 is provided in the cylinder head 7. As shown in FIG. 4, the exhaust port 22 communicates at the upper end thereof with the valving element slide hole 20. The lower end portion of the exhaust port 22 projects downward from the lower side of the cylinder head 7 and opens to the exterior thereof.

A first exhaust path 23 extends approximately horizontally from the position of the discharge hole 10 to the valving element slide hole 20. The first exhaust path 23 communicates at one end thereof with the air supply passage 12 and at the other end thereof with the valving element slide hole 20 on the valve seat (21) side. The first exhaust path 23 constitutes a first exhaust passage 24 in combination with the valving element slide hole 20 and the exhaust port 22.

A first pilot passage 25 is formed in the cylinder head 7. The first pilot passage 25 is disposed approximately parallel to the valving element slide hole 20 and the first exhaust path 23. The first pilot passage 25 communicates at one end thereof with the air supply passage 12. At the other (distal) end thereof, the first pilot passage 25 communicates with a pilot chamber 43 of the pilot-operated switching valve 38 (described later) to introduce compressed air from the air supply passage 12 to the pilot chamber 43 as a pilot pressure.

A branch path 26 branches out from an intermediate part of the first pilot passage 25. As shown in FIGS. 2 and 3, the branch path 26 is formed in the shape of a stepped hole extending in the radial direction of the first pilot passage 25. The branch path 26 communicates with an upstream-side chamber 36A of the solenoid-operated exhaust valve 30 (described later).

A second exhaust path 27 is formed in the cylinder head 7 so as to extend approximately parallel to the branch path 26. The second exhaust path 27 communicates at one end thereof with a downstream-side chamber 36B of the solenoid-operated exhaust valve 30 (described later). At the other end thereof, the second exhaust path 27 communicates with the exhaust port 22, as shown in FIG. 4. The second exhaust path 27 has a smaller flow path area than that of the first exhaust path 23. As will be stated later, the second exhaust path 27 has such a passage diameter that when compressed air flows therethrough, the second exhaust path 27 produces an orifice resistance or restriction resistance in combination with an air hole 37 (described later), for example.

The second exhaust path 27 constitutes a second exhaust passage 28 in combination with the pilot passage 25, the branch path 26, and the upstream-side chamber 36A and downstream-side chamber 36B of the solenoid-operated exhaust valve 30. The second exhaust passage 28 is connected between the air supply passage 12 and the exhaust port 22 in parallel to the first exhaust passage 24.

A second pilot passage 29 is formed in the cylinder head 7. As shown in FIG. 3, the second pilot passage 29 is disposed opposite to the second exhaust path 27 across the branch path 26. The second pilot passage 29 extends approximately parallel to the second exhaust path 27. The second pilot passage 29 communicates at one end thereof with the downstream-side chamber 36B of the solenoid-operated exhaust valve 30. At the other end thereof, the second pilot passage 29 communicates with a pilot chamber 44 of the pilot-operated switching valve 38 (described later).

The solenoid-operated exhaust valve 30 is provided in the valve-accommodating cylinder 14 at an intermediate position in the second exhaust passage 28. As shown in FIGS. 2 and 3, the solenoid-operated exhaust valve 30 consists essentially of a valve casing 32 and a valving element 35. The valve casing 32 has a coil 31 wound around the outer periphery thereof. The valve casing 32 has a valve seat portion 32A at one end thereof. The end portion of the valve casing 32 where the valve seat portion 32A is provided is fitted into a large-diameter portion of the branch path 26 in an airtight manner. The valving element 35 is disposed in the valve casing 32 opposite to a core 33. The valving element 35 is constantly urged toward the valve seat portion 32A of the valve casing 32 by a valve spring 34.

The valve casing 32 of the solenoid-operated exhaust valve 30 defines the upstream-side chamber 36A and the downstream-side chamber 36B in the bottom of the valve-accommodating cylinder 14. The upstream-side chamber 36A is located upstream the valve seat portion 32A. The downstream-side chamber 36B is located downstream the valve seat portion 32A. An air hole 37 with a small diameter is provided in the center of the valve seat portion 32A. The air hole 37 is selectively opened or closed by the valving element 35. In the solenoid-operated exhaust valve 30, when the external supply of an electric current is stopped (cut off), the valving element 35 is rested on the valve seat portion 32A by the valve spring 34 to close the air hole 37, thereby cutting off the communication between the upstream-side chamber 36A and the downstream-side chamber 36B.

When the solenoid-operated exhaust valve 30 is externally supplied with an electric current to excite the coil 31, the valving element 35 is attracted toward the core 33 against the valve spring 34 and thus separated from the valve seat portion 32A to open the air hole 37. Consequently, the upstream-side chamber 36A and the downstream-side chamber 36B communicate with each other, and thus the compressed air supplied from the air supply passage 12 (first pilot passage 25) flows from the upstream-side chamber 36A to the downstream-side chamber 36B.

In this case, when the solenoid-operated exhaust valve 30 is closed, the valving element 35 rests on the valve seat portion 32A to close the air hole 37. Therefore, the valving element 35 receives the pressure of compressed air with a pressure-receiving area corresponding to the diameter (port diameter) of the air hole 37. For this reason, the urging force of the valve spring 34 is necessary to increase according to the port diameter of the air hole 37. If the urging force of the valve spring 34 is increased, the size of the coil 31 must be increased correspondingly.

The pilot-operated switching valve 38 is provided in the cylinder head 7 at an intermediate position in the first exhaust passage 24. The pilot-operated switching valve 38 consists essentially of a spool-type valving element 39, a cover 40, and a spring 41. The spool-type valving element 39 is fitted in the valving element slide hole 20, and one end of the valving element 39 selectively rests on or separates from the valve seat 21. The cover 40 is located at the other end of the valving element 39 to close the open end of the valving element slide hole 20.

The spring 41 is placed between the valving element 39 and the cover 40 to constantly urge the valving element 39 toward the valve seat 21 with relatively weak spring force.

An annular groove 39A is formed on the outer periphery of one (distal) end portion of the valving element 39 that faces the valve seat 21. The annular groove 39A defines an annular passage 42 between itself and the inner peripheral wall of the valving element slide hole 20. The annular passage 42 communicates with the exhaust port 22 at all times. An annular collar 39B projects radially outward from an axially intermediate portion of the valving element 39. The annular collar 39B defines first and second pilot chambers 43 and 44 in the valving element slide hole 20.

The first and second pilot chambers 43 and 44 are separate from each other in the axial direction of the valving element 39. The first pilot chamber 43, which is closer to the cover 40, communicates with the first pilot passage 25 at all times. The second pilot chamber 44 communicates with the second pilot passage 29 at all times. As shown in FIG. 4, the annular collar 39B of the valving element 39 is arranged such that the pressure-receiving area S1 with respect to the first pilot chamber 43 is smaller than the pressure-receiving area S2 with respect to the second pilot chamber 44 as expressed by the following formula (1):

$$S2>S1>S3$$

Furthermore, the valving element 39 has a pressure-receiving area S3 with respect to the first exhaust path 23 in a state where the valving element 39 rests on the valve seat 21. The pressure-receiving area S3 is smaller than the pressure-receiving area S1 with respect to the first pilot chamber 43 as expressed by the above formula (1).

The following is a description of the operation of the air compressor for use in a vehicle according to this embodiment, which has the above-described arrangement.

First, in a state where the air compressor is mounted on a vehicle, the discharge port 13, which is provided in the cylinder head 7, is connected to an air-suspension system (not shown) of the vehicle through an air dryer (not shown). To raise the vehicle height through the air-suspension system, the piston 5 is caused to reciprocate in the cylinder 4, thereby compressing air sucked from the suction valve 15 in the cylinder 4 and discharging the compressed air from the discharge valve 17 into the air supply passage 12.

In this case, the solenoid-operated exhaust valve 30, which is provided in the cylinder head 7, is kept closed. Consequently, as shown in FIGS. 2 and 3, the communication between the upstream-side chamber 36A and downstream-side chamber 36B of the solenoid-operated exhaust valve 30 is cut off by the valving element 35. In the pilot-operated switching valve 38, the pilot chamber 44 communicates with the exhaust port 22 through the second pilot passage 29, the downstream-side chamber 36B and the second exhaust path 27 and thus continues communicating with the outside air (i.e. the air that is exterior of the cylinder head 7). Consequently, the pressure in the pilot chamber 44 is maintained at a low pressure, which is substantially equal to that of the outside air.

On the other hand, the pilot chamber 43 of the pilot-operated switching valve 38 is supplied with the compressed air from the air supply passage 12 through the first pilot passage 25 as a pilot pressure. Accordingly, the valving element 39 receives the pilot pressure from the pilot chamber 43 with the pressure-receiving area S1 as shown in FIG. 4. Consequently, the valving element 39 is pressed in the valve closing direction together with the spring 41.

Meanwhile, the valving element 39 receives the pilot pressure from the exhaust path 23 on the valve seat (21) side with the pressure-receiving area S3. However, because the pressure-receiving area S1 is larger than the pressure-receiving area S3 as expressed by the above formula (1), the valving element 39 is maintained in the valve closing position.

The communication between the exhaust path 23 and the exhaust port 22 is cut off by the valving element 39. Thus, the compressed air in the air supply passage 12 is prevented from flowing toward the exhaust path 23. Consequently, the compressed air discharged into the air supply passage 12 from the discharge valve 17 is supplied only to the air-suspension system side from the discharge port 13 toward the external air dryer. In the air-suspension system, the air chamber is expanded by the supply of compressed air. Thus, vehicle height adjustment is performed so that the vehicle height is raised.

Next, to lower the vehicle height, the solenoid-operated exhaust valve 30 is opened in a state where the piston 5 is stopped from reciprocating, thereby causing the valving element 35 to open the air hole 37 and thus allowing the upstream-side chamber 36A and the downstream-side chamber 36B to communicate with each other. Consequently, the pilot passage 25 communicates with the exhaust port 22 through the branch path 26, the upstream-side chamber 36A, the downstream-side chamber 36B and the exhaust path 27, and a part of the compressed air in the air supply passage 12 is discharged to the exterior of the cylinder head 7" through the solenoid-operated exhaust valve 30.

However, the pilot passage 25 and the exhaust path 27 are formed with a smaller flow path area than that of the exhaust path 23. Therefore, the compressed air discharged at this time is subjected to a restriction resistance when flowing through the exhaust path 27, for example. Accordingly, a pilot pressure approximately equal to the pressure in the pilot passage 25 can be generated in the pilot passage 29.

Therefore, approximately equal pilot pressures are supplied to the pilot chambers 43 and 44 of the pilot-operated switching valve 38. Because the valving element 39 is so arranged that the pressure-receiving area S2 on the pilot chamber (44) side is larger than the pressure-receiving area S1 on the pilot chamber (43) side as expressed by the above formula (1), the valving element 39 is moved to a valve opening position against the spring 41, which is a relatively weak spring.

When the valving element 39 of the pilot-operated switching valve 38 moves to the valve opening position, the exhaust path 23 communicates with the exhaust port 22. Consequently, the compressed air in the air supply passage 12 is discharged to the exterior of the cylinder head through the exhaust path 23, the annular passage 42 and the exhaust port 22. Accordingly, compressed air can be discharged from the air chamber of the air-suspension system through the first exhaust passage 24 (exhaust path 23) and the second exhaust passage 28 (exhaust path 27) in a large amount (at a high flow rate) within a short period of time.

Thus, according to this embodiment, the first and second exhaust passages 24 and 28 are provided in parallel between the air supply passage 12 and exhaust port 22 of the cylinder head 7. The pilot-operated switching valve 38 is provided at an intermediate position in the first exhaust passage 24, and the solenoid-operated exhaust valve 30 is provided at an intermediate position in the second exhaust passage 28. The solenoid-operated exhaust valve 30 is selectively opened or closed with an externally supplied electric current, thereby supplying or discharging a pilot pressure for open/close control with respect to the valving element 39 of the pilot-operated switching valve 38.

When the valving element 35 of the solenoid-operated exhaust valve 30 is caused to open the air hole 37 to thereby allow the upstream-side chamber 36A and the downstream-side chamber 36B to communicate with each other in order to adjust the vehicle height to a lower level, the pilot passage 25 can communicate with the exhaust port 22 through the branch path 26, the upstream-side chamber 36A, the downstream-side chamber 36B and the exhaust path 27. Accordingly, the compressed air in the air supply passage 12 can be discharged to the exterior of the cylinder head 7 from the second exhaust passage 28 at a relatively low flow rate. In addition, a pilot pressure for moving the valving element 39 in the valve opening direction can be supplied from the pilot passage 29 to the pilot chamber 44 of the pilot-operated switching valve 38.

As a result, the valving element 39 of the pilot-operated switching valve 38 allows the exhaust path 23 to communicate with the exhaust port 22. Consequently, the compressed air in the air supply passage 12 can be discharged to the exhaust port 22 from the exhaust path 23 at a high flow rate. Thus, compressed air can be discharged from the air chamber of the air-suspension system through the first and second exhaust passages 24 and 28 simultaneously. Accordingly, it is possible to surely shorten the time required to discharge compressed air to lower the vehicle height.

In the prior art, compressed air is discharged to the exterior of the cylinder head 7 only through the air hole 37 of the solenoid-operated exhaust valve 30, for example. Therefore, it is difficult to shorten the time required to discharge compressed air unless the port diameter of the air hole 37 is increased, and it is necessary in order to increase the port diameter of the air hole 37 to make a design change so that the solenoid-operated exhaust valve 30 becomes large in size.

In contrast, this embodiment enables compressed air to be discharged rapidly at a high flow rate through the first and second exhaust passages 24 and 28 by the solenoid-operated exhaust valve 30 and the pilot-operated switching valve 38. Accordingly, the time required to discharge compressed air during vehicle height adjustment can be surely shortened. Moreover, the solenoid-operated exhaust valve 30 need not be made large in size, and it is possible to use the currently used solenoid-operated exhaust valve.

Accordingly, this embodiment enables the compressed air discharge speed can be increased without increasing the size of the cylinder head 7. Consequently, vehicle height adjustment, for example, can be effected within a reduced period of time. In addition, the air compressor for use in a vehicle can be made small in size and formed in a compact structure as a whole.

FIGS. 5 to 8 show a second embodiment of the present invention. The feature of this embodiment also resides in that an annular pressure-receiving chamber is formed between a portion of a valving element slide hole in a pilot-operated switching valve and a valving element thereof, and when a solenoid-operated exhaust valve is closed, the pressure-receiving chamber is opened to the atmosphere, whereas when the solenoid-operated exhaust valve is opened, a pilot pressure is introduced into the pressure-receiving chamber to move the valving element to a valve opening position. It should be noted that in this embodiment the same constituent elements as those in the first embodiment are denoted by the same reference numerals, and a description thereof is omitted.

Referring to the figures, an air compressor 51 employed in this embodiment includes a crank case 1, a motor casing 2, a crankshaft 3 having a balance weight 3A, a cylinder 4, a piston 5 and a connecting rod 6 in substantially the same way as in the first embodiment.

Figure 6:
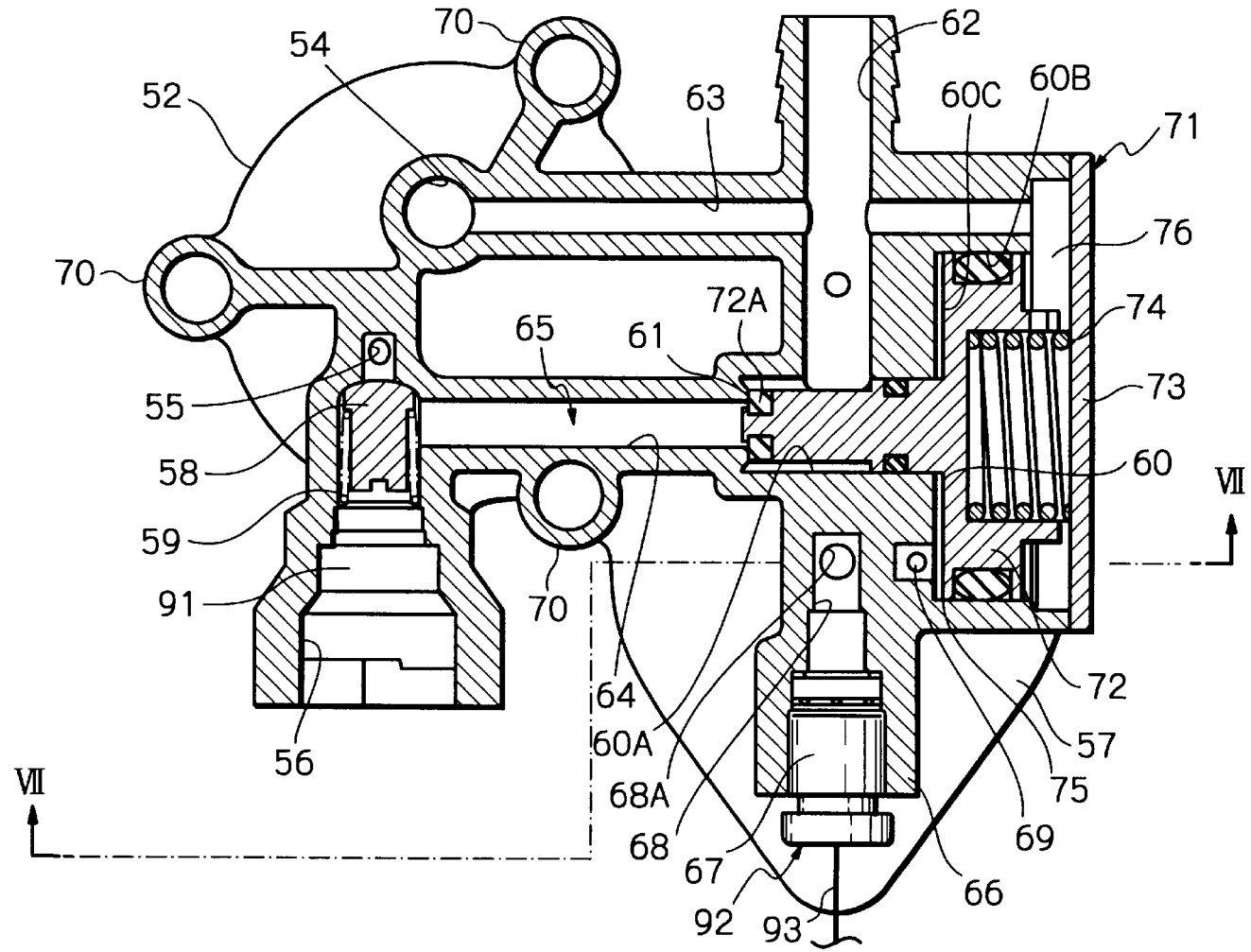
FIG. 6 is an enlarged sectional view as seen from the direction of the arrow VI—VI in FIG. 5, showing a pilot-operated switching valve provided in a cylinder head.

A cylinder head 52 is mounted on the cylinder 4 by using bolts 53 to serve as a passage member. The cylinder head 52 is arranged in approximately the same way as the cylinder head 7 stated in the first embodiment. As shown in FIG. 6, the cylinder head 52 is provided with a suction hole 54, a discharge hole 55, a discharge port 56, and exhaust passages 65 and 92 (described later). It should be noted that the discharge port 56, which is provided in the cylinder head 52, constitutes a part of an air supply passage 91 (described later).

Figure 5:
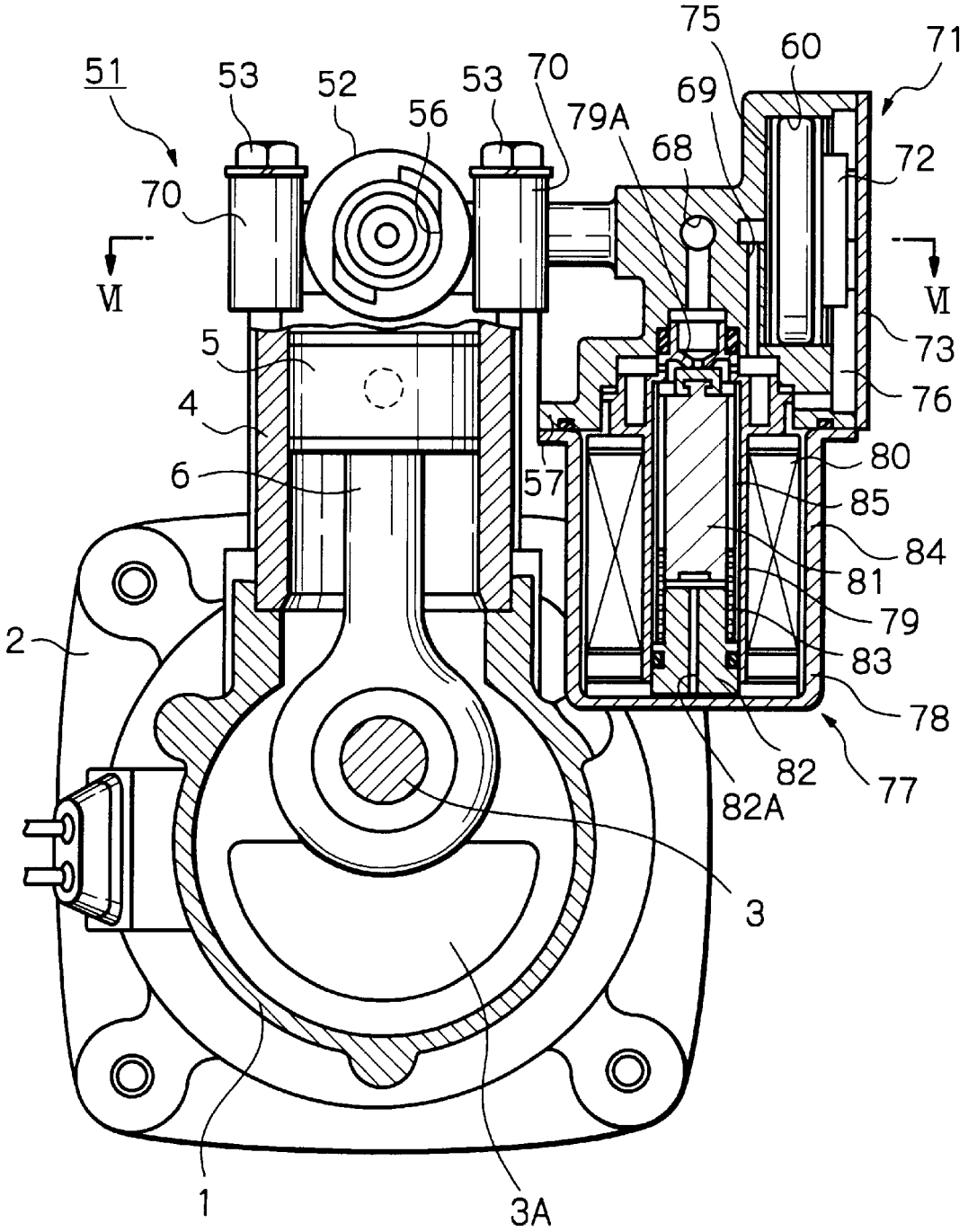
FIG. 5 is a vertical sectional view of an air compressor according to a second embodiment of the present invention.
Figure 7:
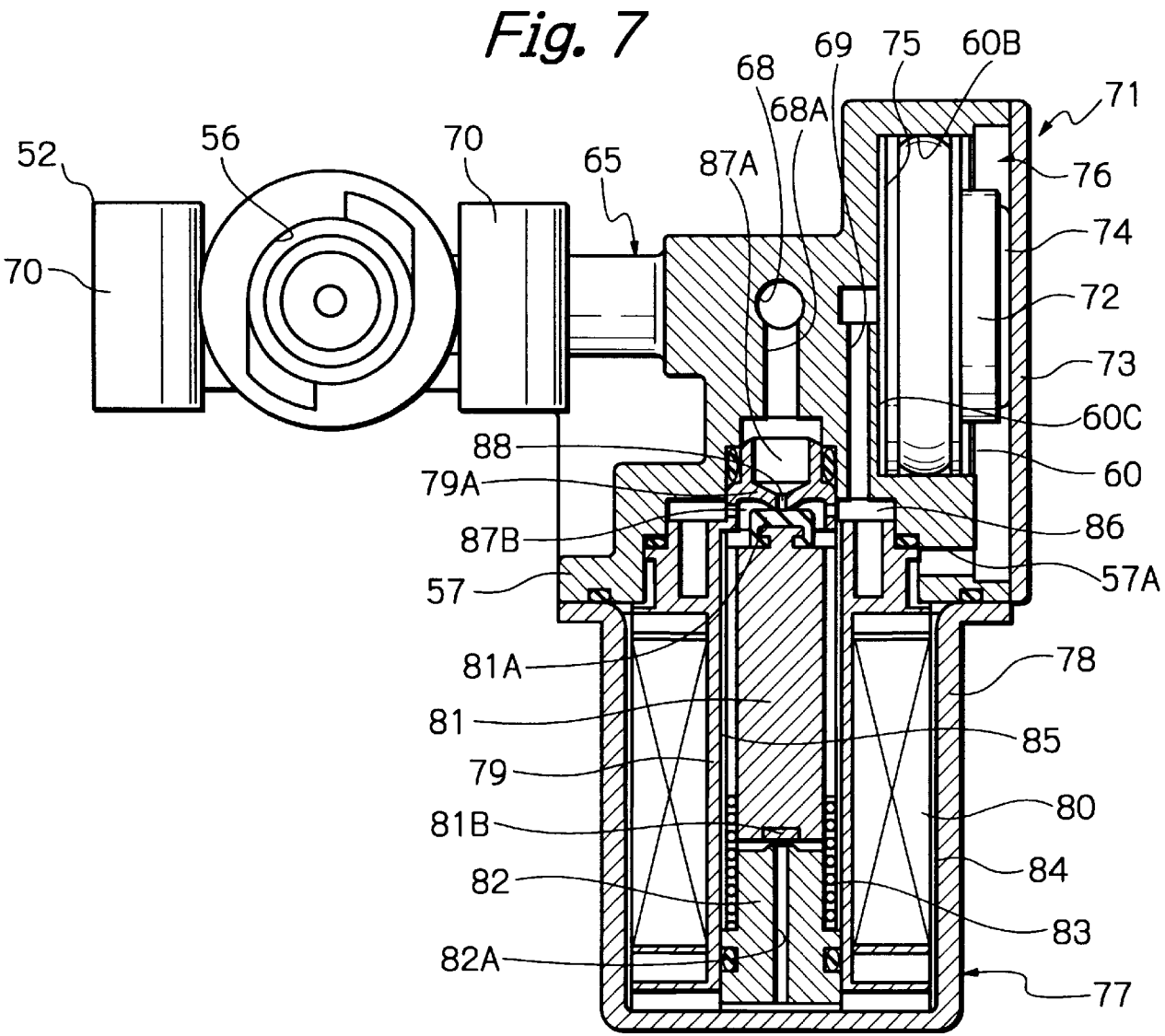
FIG. 7 is an enlarged sectional view as seen from the direction of the arrow VII—VII in FIG. 6, showing a solenoid-operated exhaust valve provided in the cylinder head.

As shown in FIGS. 5 and 7, the cylinder head 52 is provided with a stepped valve-mounting portion 57. The valve-mounting portion 57 is located on a side of the cylinder 4 and opens downward. A solenoid-operated exhaust valve 77 (described later) is detachably attached to the valve-mounting portion 57. As shown in FIG. 7, the valve-mounting portion 57 is provided with a radial air hole 57A. The air hole 57A communicates with an atmospheric chamber 76 of a pilot-operated switching valve 71 (described later) at all times.

A discharge valve 58 selectively opens or closes the discharge hole 55. The discharge valve 58 is constantly urged in a valve closing direction by a valve spring 59. When opened, the discharge valve 58 allows compressed air from the discharge hole 55 to flow to the discharge port 56.

A valving element slide hole 60 is formed in the cylinder head 52 as a stepped hole. As shown in FIG. 6, the valving element slide hole 60 has a small-diameter hole portion 60A extending in the horizontal direction and communicating at one end thereof with an exhaust path 64 (described later). The valving element slide hole 60 further has a large-diameter hole portion 60B located at the other end of the small-diameter hole portion 60A and opening to the exterior of the cylinder head 52. An annular shoulder portion 60C is formed between the small-diameter hole portion 60A and the large-diameter hole portion 60B.

The valving element slide hole 60 constitutes a part of the pilot-operated switching valve 71 (described later). A valve seat 61 is formed at the boundary between the small-diameter hole portion 60A of the valving element slide hole 60 and the exhaust path 64. A stepped valving element 72 (described later) selectively rests on or separates from the valve seat 61.

A suction and exhaust port 62 is provided in the cylinder head 52 to extend in a direction approximately perpendicular to the valving element slide hole 60. As shown in FIG. 6, the suction and exhaust port 62 communicates at the proximal end thereof with the small-diameter hole portion 60A of the valving element slide hole 60. The distal end of the suction and exhaust port 62 projects rearward from the cylinder head 52 and opens to the exterior of the cylinder head 52".

A suction path 63 is provided in the cylinder head 52 to intersect the suction and exhaust port 62 approximately at right angles. The suction path 63 communicates at one end thereof with the suction hole 54 and at the other end thereof with the suction and exhaust port 62. During the operation of the air compressor 51, when a suction valve (not shown) is opened, air is sucked into the cylinder 4 through the suction and exhaust port 62, the suction path 63 and the suction hole 54.

An exhaust path 64 extends approximately horizontally from the position of the discharge valve 58 to the valving element slide hole 60. The exhaust path 64 communicates at one end thereof with the discharge port 56 and at the other end thereof with the valving element slide hole 60 on the valve seat (61) side. The exhaust path 64 constitutes a first exhaust passage 65 in combination with the valving element slide hole 60 and the suction and exhaust port 62.

A connecting port 66 is provided in the cylinder head 52. The connecting port 66 is located opposite to the suction and exhaust port 62 across the small-diameter hole portion 60A of the valving element slide hole 60. The connecting port 66 is provided with a joint 67. The joint 67 is connected to an air supply passage 91 (shown in FIG. 8) through a branch piping 93 (described later).

A pressure-introducing path 68 is provided in the cylinder head 52 so as to communicate with the connecting port 66 at all times. As shown in FIG. 7, the pressure-introducing path 68 has a stepped passage portion 68A extending downward. The passage portion 68A communicates at the lower end (large-diameter portion) thereof with an upstream-side chamber 87A of a solenoid-operated exhaust valve 77 (described later) at all times.

A pilot passage 69 is provided in the cylinder head 52. The pilot passage 69 is formed as a downwardly-extending elongated passage located between the annular step portion 60C of the valving element slide hole 60 and the passage portion 68A of the pressure-introducing path 68. The pilot passage 69 communicates at the upper end thereof with a pressure-receiving chamber 75 of the pilot-operated switching valve 71 (described later) at all times. At the lower end thereof, the pilot passage 69 communicates with an annular passage 86 (described later).

Bolt-passing portions 70 with a cylindrical shape are provided on the cylinder head 52. As shown in FIG. 5, bolts 53 are passed through the bolt-passing portions 70, respectively. Thus, the cylinder head 52 is detachably secured to the upper end of the cylinder 4.

The pilot-operated switching valve 71 is provided in the cylinder head 52 at an intermediate position in the first exhaust passage 65. As shown in FIG. 6, the pilot-operated switching valve 71 consists essentially of a stepped valving element 72, a cover 73, and a spring 74. The stepped valving element 72 is fitted in the valving element slide hole 60. One end portion of the stepped valving element 72 is defined as a valve portion 72A that selectively rests on or separates from the valve seat 61. The cover 73 is located at the other end of the stepped valving element 72 to close the open end of the valving element slide hole 60. The spring 74 is placed between the stepped valving element 72 and the cover 73 to serve as an urging device that urges the stepped valving element 72 toward the valve seat 61 at all times. It should be noted that the cover 73 constitutes a passage member in combination with the cylinder head 52.

The stepped valving element 72 defines an annular pressure-receiving chamber 75 as a pilot chamber between itself and the annular step portion or shoulder 60C of the valving element slide hole 60. The annular pressure-receiving chamber 75 is selectively allowed to communicate with the pressure-introducing path 68 or the atmosphere through the pilot passage 69, the solenoid-operated exhaust valve 77 and so forth. The spring 74 of the pilot-operated switching valve 71 constantly urges the stepped valving element 72 in a direction in which the annular pressure-receiving chamber 75 contracts. By causing the valve portion 72A of the stepped valving element 72 to rest on the valve seat 61, the pilot-operated switching valve 71 is held in a valve closing position (I) shown in FIG. 8.

When the solenoid-operated exhaust valve 77 (described later) is switched from a low-pressure position (a) to a high-pressure position (b), a high pressure is supplied from the pressure-introducing path 68 to the annular pressure-receiving chamber 75 through the pilot passage 69. Consequently, the pilot-operated switching valve 71 is switched from the valve closing position (I) to a valve opening position (II) against the spring 74. At this time, the stepped valving element 72 of the pilot-operated switching valve 71 is displaced in the valving element slide hole 60 against the spring 74 to separate from the valve seat 61, thereby allowing the exhaust path 64 to communicate with the suction and exhaust port 62, and thus discharging compressed air from the air supply passage 91 to the exterior of the cylinder head 52.

An atmospheric chamber 76 is formed between the cylinder head 52 and the cover 73 at the open end of the valving element slide hole 60. The atmospheric chamber 76 constantly communicates with the outside or atmospheric air through the suction path 63 and the suction and exhaust port 62 and is maintained at the atmospheric pressure. The atmospheric chamber 76 also constantly communicates with an outer passage portion 84 of the solenoid-operated exhaust valve 77 (described later) through the air hole 57A (shown in FIG. 7), which is formed in the valve-mounting portion 57 of the cylinder head 52.

The solenoid-operated exhaust valve 77 is attached to the valve-mounting portion 57 of the cylinder head 52 to extend downward by the side of the cylinder 4. As shown in FIGS. 5 and 7, the solenoid-operated exhaust valve 77 is formed in the shape of a cylinder, one end of which is closed. The solenoid-operated exhaust valve 77 has a valve casing 78 detachably attached at the upper open end thereof to the valve-mounting portion 57 of the cylinder head 52. A valve-retaining cylinder 79 is placed in the valve casing 78. The valve-retaining cylinder 79 has a valve seat portion 79A at the upper end thereof. The valve seat portion 79A is fitted into the large-diameter portion of the passage portion 68A in an airtight manner. A coil 80 is wound on the outer periphery of the valve-retaining cylinder 79 so as to lie between the valve-retaining cylinder 79 and the valve casing 78. The solenoid-operated exhaust valve 77 further has a valving element 81, a core 82, etc. (described later).

The valving element 81 of the solenoid-operated exhaust valve 77 is placed in the valve-retaining cylinder 79 to face opposite to the core 82. As shown in FIG. 7, the valving element 81 is slidably fitted in the valve-retaining cylinder 79 directly above the core 82. The valving element 81 has a first valve portion 81A provided at the upper end thereof. The first valve portion 81A selectively rests on or separates from the valve seat portion 79A. A valve spring 83 is placed between the valving element 81 and the core 82. The valve spring 83 constantly urges the valving element 81 upward toward the valve seat portion 79A of the valve-retaining cylinder 79.

The core 82 has an air passage 82A with a small diameter provided axially in the center thereof. A second valve portion 81B is provided on the bottom of the valving element 81 to selectively open or close the air passage 82A. The air passage 82A of the core 82 communicates at the lower end thereof with an annular outer passage portion 84 formed between the valve casing 78 and the coil 80. Thus, the air passage 82A constantly communicates with the atmospheric chamber 76, which is formed inside the cover 73, through the outer passage portion 84 and the air hole 57A of the valve-mounting portion 57. On the other hand, an inner passage portion 85 is provided between the valving element 81 and the valve-retaining cylinder 79. The inner passage portion 85 is formed from a groove axially extending on the outer periphery of the valving element 81. The inner passage portion 85 is selectively brought into or out of communication with the air passage 82A by the second valve portion 81B.

The valve-retaining cylinder 79 of the solenoid-operated exhaust valve 77 is fitted to the valve-mounting portion 57 of the cylinder head 52 from below, and an annular passage 86 is formed around the outer periphery of the valve-retaining cylinder 79. The annular passage 86 communicates with the pilot passage 69 at all times. The valve-retaining cylinder 79 defines an upstream-side chamber 87A and a downstream-side chamber 87B between itself and the passage portion 68A of the pressure-introducing path 68. The upstream-side chamber 87A is located above (upstream) the valve seat portion 79A. The downstream-side chamber 87B is located below (downstream) the valve seat portion 79A. The downstream-side chamber 87B communicates with the annular passage 86 at all times.

An air hole 88 with a small diameter is provided in the center of the valve seat portion 79A. The air hole 88 is selectively opened or closed by the valve portion 81A of the valving element 81. In the solenoid-operated exhaust valve 77, when the external supply of an electric current is stopped (cut off), as shown in FIG. 7, the first valve portion 81A of the valving element 81 is caused to rest on the valve seat portion 79A by the valve spring 83 to close the air hole 88, thereby cutting off the communication between the upstream-side chamber 87A and the downstream-side chamber 87B.

In this case, the inner passage portion 85 between the valve-retaining cylinder 79 and the valving element 81 constantly communicates with the downstream-side chamber 87B at the first valve portion (81A) side. In addition, because the second valve portion 81B opens the air passage 82A of the core 82, the inner passage portion 85 also communicates with the outer passage portion 84 through the air passage 82A. Consequently, the annular pressure-receiving chamber 75 of the pilot-operated switching valve 71 communicates with the atmospheric chamber 76 through the pilot passage 69, the annular passage 86, the downstream-side chamber 87B, the inner passage portion 85 and the air passage 82A of the core 82. Thus, the pressure-receiving chamber 75 is maintained at the atmospheric pressure.

On the other hand, when the solenoid-operated exhaust valve 77 is externally supplied with an electric current to excite the coil 80, the valving element 81 is attracted toward the core 82 against the valve spring 83, causing the first valve portion 81A of the valving element 81 to separate from the valve seat portion 79A. At this time, because the valve portion 81A of the valving element 81 opens the air hole 88, the upstream-side chamber 87A and the downstream-side chamber 87B communicate with each other. Consequently, compressed air from the pressure-introducing path 68 (air supply passage 91) is supplied to the pressure-receiving chamber 75 of the pilot-operated switching valve 71 through the upstream-side chamber 87A, the downstream-side chamber 87B, the annular passage 86 and the pilot passage 69.

Figure 8:
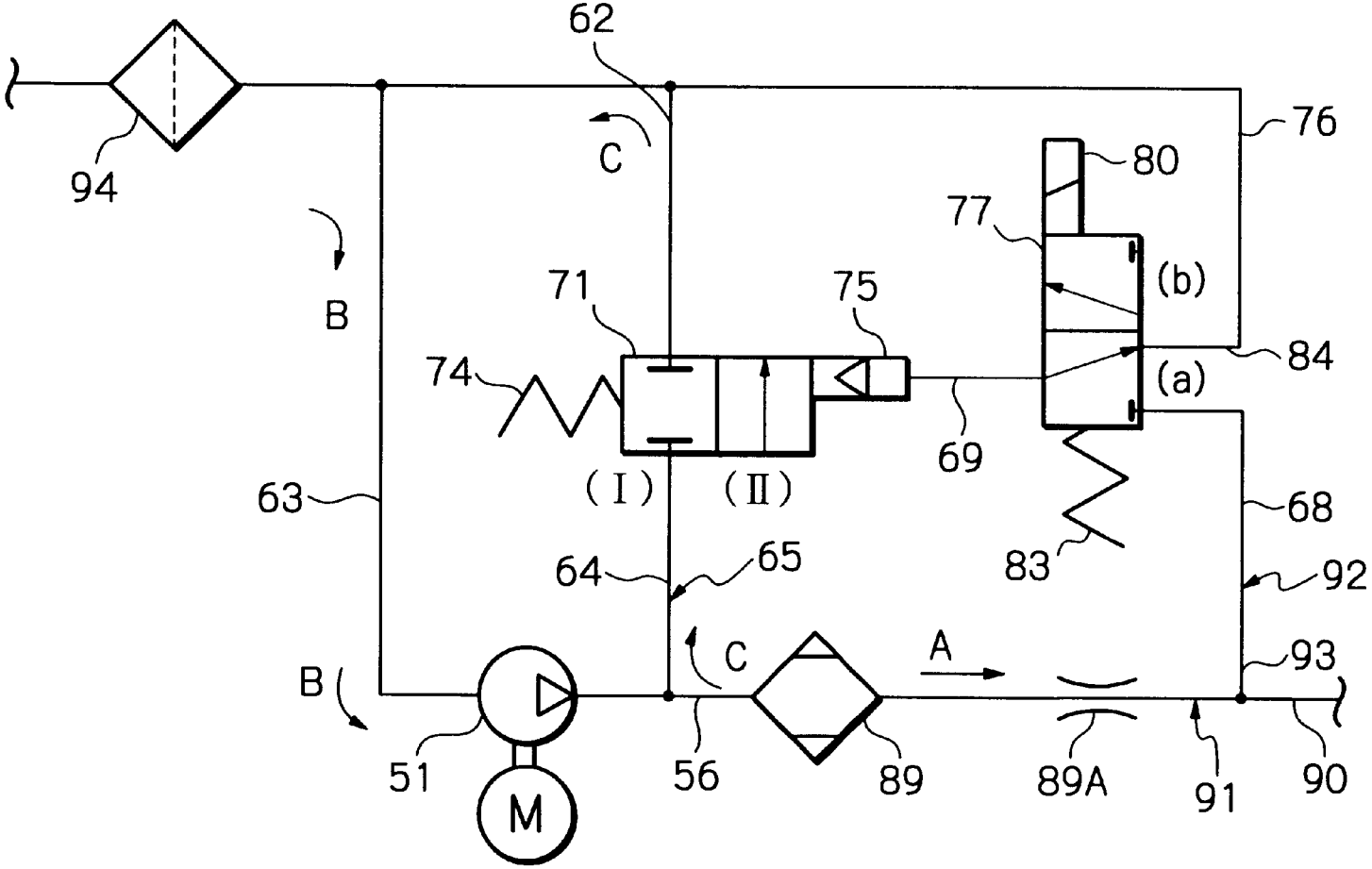
FIG. 8 is a pneumatic circuit diagram showing the air compressor according to the second embodiment, together with the solenoid-operated exhaust valve and the pilot-operated switching valve, etc.

In the state where the valving element 81 has been driven against the valve spring 83 by the externally supplied electric current, the second valve portion 81B closes the air passage 82A of the core 82. Consequently, the inner passage portion 85 is cut off from the outer passage portion 84 and the atmospheric chamber 76. Therefore, the solenoid-operated exhaust valve 77 is switched from the low-pressure position (a) to the high-pressure position (b), which are shown in FIG. 8. Thus, the high pressure from the pressure-introducing path 68 is supplied to the annular pressure-receiving chamber 75 through the pilot passage 69 to switch the pilot-operated switching valve 71 from the valve closing position (I) to the valve opening position (II) against the spring 74.

That is, the solenoid-operated exhaust valve 77 is arranged as a three-port, two-position solenoid-operated directional control valve as shown in FIG. 8. When the coil 80 is not energized, the solenoid-operated exhaust valve 77 is held in the low-pressure position (a) by the valve spring 83. Thus, the pilot passage 69 is allowed to communicate with the atmospheric chamber 76, thereby maintaining the annular pressure-receiving chamber 75 at the atmospheric pressure (low pressure). When the coil 80 is energized, the solenoid-operated exhaust valve 77 is switched from the low-pressure position (a) to the high-pressure position (b) against the valve spring 83 to introduce compressed air from the pressure-introducing path 68 to the pilot passage 69, thereby maintaining the annular pressure-receiving chamber 75 at high pressure.

An air dryer 89 is connected to the discharge port 56 of the cylinder head 52. The air dryer 89 dries compressed air discharged from the discharge port 56 and supplies dry compressed air to a pneumatic apparatus (not shown) such as an air-suspension system through an air duct 90 in the direction of the arrow A in FIG. 8. The air dryer 89 is provided with a restrictor 89A to adjust the flow rate of air passing through the air dryer 89.

An air supply passage 91 adopted in this embodiment comprises the discharge port 56, the air dryer 89, and the air duct 90.

A second exhaust passage 92 adopted in this embodiment is connected to an intermediate part of the air supply passage 91 in parallel relation to the first exhaust passage 65. More specifically, the second exhaust passage 92 includes the branch piping 93 (shown in FIG. 6) that branches out from the air supply passage 91 at a position between the air dryer 89 and the air-suspension system. The second exhaust passage 92 further includes the pressure-introducing path 68, the upstream-side chamber 87A, the downstream-side chamber 87B, the inner passage portion 85, the air passage 82A of the core 82, and the outer passage portion 84, which constitute the solenoid-operated exhaust valve 77, and further the air hole 57A of the valve-mounting portion 57 and the atmospheric chamber 76.

As shown in FIG. 8, a suction filter 94 is connected to the suction and exhaust port 62. The suction filter 94 sucks the outside air into the suction path 63 in the direction of the arrow B in FIG. 8 while cleaning the air. When compressed air is discharged, foreign matter such as dust attached to the suction filter 94 is removed by using the air flowing in the direction of the arrow C.

With the above-described arrangement, this embodiment also provides advantageous effects substantially similar to those of the first embodiment. In this embodiment in particular, the annular pressure-receiving chamber 75 of the pilot-operated switching valve 71 is connected to the pilot passage 69 formed in the cylinder head 52, and the pilot passage 69 is selectively allowed to communicate with the atmospheric chamber 76 or the pressure-introducing path 68 by the solenoid-operated exhaust valve 77. Therefore, the following advantageous effects are obtained.

That is, when the solenoid-operated exhaust valve 77, which is a three-port, two-position solenoid-operated directional control valve, is held in the low-pressure position (a) by the valve spring 83, the pilot passage 69 is allowed to communicate with the atmospheric chamber 76 through the annular passage 86, the downstream-side chamber 87B, the inner passage portion 85, the air passage 82A of the core 82, and the outer passage portion 84, thereby allowing the pressure-receiving chamber 75 to be maintained at the atmospheric pressure.

Thus, the stepped valving element 72 of the pilot-operated switching valve 71 is urged by the spring 74 in the direction for contracting the annular pressure-receiving chamber 75 and rested on the valve seat 61, thereby allowing the pilot-operated switching valve 71 to be maintained in the valve closing position (I) shown in FIG. 8. Accordingly, it is possible to prevent compressed air in the air supply passage 91 from being discharged to the exterior of the cylinder head 52 through the suction and exhaust port 62.

When the air compressor 51 is operated in this state and thus the piston 5 is caused to reciprocate in the cylinder 4, air is sucked in from the suction hole 54 and compressed in the cylinder 4, and while doing so, the compressed air is supplied to the air-suspension system from the discharge valve 58 through the discharge port 56, the air dryer 89 and the air duct 90 in the direction of the arrow A, thereby allowing vehicle height adjustment to be made so that the vehicle height is raised through the =air-suspension system.

On the other hand, to lower the vehicle height, the coil 80 of the solenoid-operated exhaust valve 77 is energized to switch the valving element 81 from the low-pressure position (a) to the high-pressure position (b) against the valve spring 83. Consequently, compressed air in the air supply passage 91 is supplied to the annular pressure-receiving chamber 75 from the pressure-introducing path 68 through the pilot passage 69. Thus, the pilot-operated switching valve 71 is switched from the valve closing position (I) to the valve opening position (II) against the spring 74.

In this case, the stepped valving element 72 of the pilot-operated switching valve 71 is displaced in the valving element slide hole 60 against the spring 74 by the pressure of compressed air supplied into the pressure-receiving chamber 75, causing the valve portion 72A to separate from the valve seat 61, and thus allowing the exhaust path 64 to communicate with the suction and exhaust port 62. Accordingly, compressed air in the air supply passage 91 can be discharged to the exterior of the cylinder head 52 from the discharge port 56 through the exhaust path 64 and the suction and exhaust port 62 in the direction of the arrow C. Thus, the vehicle height can be adjusted to a lower level by the discharge of compressed air.

Therefore, in this embodiment, the annular pressure-receiving chamber 75 of the pilot-operated switching valve 71 can be immediately switched between an atmospheric pressure state and a high-pressure state created by compressed air by switching the solenoid-operated exhaust valve 77 between the low-pressure position (a) and the high-pressure position (b). Accordingly, the stepped valving element 72 of the pilot-operated switching valve 71 can be rested on or separated from the valve seat 61 with high responsivity.

When the pilot-operated switching valve 71 is switched from the valve closing position (I) to the valve opening position (II) against the spring 74 to separate the stepped valving element 72 from the valve seat 61, compressed air can be rapidly discharged from the exhaust path 64 to the suction and exhaust port 62. Accordingly, the compressed air discharge speed can be surely increased by using a small-sized solenoid-operated exhaust valve 77. In addition, the compressed air discharge process for lowering the vehicle height can be carried out in a reduced period of time.

Although in the foregoing first embodiment the present invention is applied to an air compressor in which the suction valve 15, which selectively opens or closes the suction hole 9, is provided in the cylinder head 7, it should be noted that the present invention is not necessarily limited to the described air compressor. For example, the arrangement may be such that a suction valve is provided in a piston that reciprocates in a cylinder, and air from a crank chamber is sucked into a compression chamber in the cylinder. This is true of the second embodiment.

Air compressors to which the present invention is applicable are not necessarily limited to those illustrated in FIGS. 1 and 5. The present invention is applicable to various air compressors, for example, an air compressor using a rocking piston, and a diaphragm-operated air compressor.

As has been detailed above, according to the present invention, a passage member is provided with first and second exhaust passages connected to an air supply passage in parallel to each other. The first exhaust passage is provided with a pilot-operated switching valve that receives compressed air from the air supply passage as a pilot pressure to selectively bring the first exhaust passage into or out of communication with the exterior of the passage member. The second exhaust passage is provided with a solenoid-operated exhaust valve that selectively brings the second exhaust passage into or out of communication with the exterior of the passage member and controls the pilot pressure supplied to the pilot-operated switching valve in response to external supply of an electric current. Therefore, when the solenoid-operated exhaust valve is opened by externally supplying an electric current thereto, the second exhaust passage is allowed to communicate with the outside air. In addition, the pilot-operated switching valve is supplied with a pilot pressure acting in a valve opening direction. By opening the pilot-operated switching valve with the pilot pressure, the first exhaust passage is allowed to communicate with the outside air.

Accordingly, compressed air in the air supply passage can be discharged through both the first and second exhaust passages, and thus the compressed air discharge speed can be increased without increasing the size of the cylinder head. Consequently, it is possible to discharge compressed air from a pneumatic apparatus to the outside in a reduced period of time. For example, the time required to discharge compressed air during vehicle height adjustment can be surely shortened. In addition, an air compressor for use in a vehicle can be made small in size and formed in a compact structure as a whole.

According to a specific example of the present invention, a valving element slide hole of the pilot-operated switching valve is formed as a stepped hole provided in the passage member at an intermediate position in the first exhaust passage. A stepped valving element is fitted in the valving element slide hole to define an annular pressure-receiving chamber between the stepped valving element and an annular step portion of the valving element slide hole. In addition, an urging device is provided between the stepped valving element and the passage member to urge the stepped valving element in a valve closing direction. Normally, a pilot passage that communicates with the annular pressure-receiving chamber is allowed to open to the atmospheric air by the solenoid-operated exhaust valve. When the solenoid-operated exhaust valve is energized, the pilot passage is cut off from the atmospheric air, and compressed air from the air supply passage is introduced into the pilot passage as a pilot pressure. Therefore, the annular pressure-receiving chamber of the pilot-operated switching valve can be immediately switched between an atmospheric pressure state and a high-pressure state created by compressed air by controlling the supply of an electric current to the solenoid-operated exhaust valve. Accordingly, the pilot-operated switching valve can be opened or closed with high responsivity. In addition, when the pilot-operated switching valve is opened, compressed air in the air supply passage can be rapidly discharged through the first exhaust passage. Thus, compressed air can be discharged in a reduced period of time by using a small-sized solenoid-operated exhaust valve.

What is claimed is:

1. An air compressor comprising a drive source, a compressed air generating mechanism driven by said drive source to generate compressed air, a passage member connected to said compressed air generating mechanism and provided with an air supply passage for supplying the compressed air to a pneumatic apparatus, and an exhaust device provided in said passage member to discharge compressed air from said pneumatic apparatus to an, exterior of said passage member, wherein said exhaust device comprises:

first and second exhaust passages provided in said passage member and connected to said air supply passage in parallel with each other;

a pilot-operated switching valve provided in said first exhaust passage and supplied with compressed air from said air supply passage as a pilot pressure, thereby selectively bringing said first exhaust passage into or out of communication with the exterior of said passage member; and a solenoid-operated exhaust valve provided in said second exhaust passage to selectively bring said second exhaust passage into or out of communication with the exterior of said passage member and also to control the pilot pressure supplied to said pilot-operated switching valve in response to supply of an electric current.

2. The air compressor according to claim 1, wherein said pilot-operated switching valve includes:

a valving element slide hole formed as a stepped hole that is provided in said passage member at an intermediate position in said first exhaust passage, said valving element slide hole having a small-diameter hole portion, a large-diameter hole portion, and an annular shoulder portion formed between said small-diameter hole portion and said large-diameter hole portion;

a stepped valving element fitted in said valving element slide hole, said stepped valving element defining a first annular pressure-receiving chamber between said stepped valving element and said annular shoulder portion; and an urging device provided between said stepped valving element and said passage member to urge said stepped valving element in a direction in which said first annular pressure-receiving chamber contracts, thereby holding said stepped valving element in a valve closing position; and wherein said solenoid-operated exhaust valve normally allows a pilot passage communicating with said first annular pressure-receiving chamber to open to atmospheric air, and when excited with electric current, said solenoid-operated exhaust valve introduces compressed air from said air supply passage into said pilot passage as a pilot pressure.

3. The air compressor according to claim 2, wherein said solenoid-operated exhaust valve comprises:

a casing defining a valve seat portion having an air hole and upstream-side and downstream-side chambers on opposite sides of the valve seat portion, said upstream-side chamber being communicated with said air supply passage and said downstream-side chamber being communicated with the exterior of said passage member;

a valving element normally biased to said valve seat portion to close said air hole; and a coil which, upon being energized, actuates said valving element to open said air hole, wherein, said first annular pressure-receiving chamber is communicated with said downstream-side chamber through said pilot passage.

4. The air compressor according to claim 3, wherein said downstream-side chamber is communicated with the exterior of said passage member through a passage providing a flow resistance.

5. The air compressor according to claim 4, wherein said stepped valving element has an annular collar which defines a second pressure-receiving chamber between itself and said passage member so that the pressure established in the second pressure-receiving chamber biases the stepped valving element to a valve closing position, and wherein said second pressure-receiving chamber is communicated with said upstream-side chamber of said solenoid-operated exhaust valve.

6. The air compressor according to claim 5, wherein, when air flows through both of said first and second exhaust passages upon energizing said coil, the flow rate through said first exhaust passage is greater than that through said second exhaust passage.

7. The air compressor according to claim 4, wherein, when air flows through both of said first and second exhaust passages upon energizing said coil, the flow rate through said first exhaust passage is greater than that through said second exhaust passage.

8. The air compressor according to claim 3, wherein said downstream-side chamber is communicated with the exterior of said passage member through a passage which is shut when said coil is energized.

9. The air compressor according to claim 8, wherein, when air flows through both of said first and second exhaust passages upon energizing said coil, the flow rate through said first exhaust passage is greater than that through said second exhaust passage.

10. The air compressor according to claim 3, wherein, when air flows through both of said first and second exhaust passages upon energizing said coil, the flow rate through said first exhaust passage is greater than that through said second exhaust passage.

11. The air compressor according to claim 2, wherein, when air flows through both of said first and second exhaust passages in response to the supply of an electric current, the flow rate through said first exhaust passage is greater than that through said second exhaust passage.

12. The air compressor according to claim 1, wherein, when air flows through both of said first and second exhaust passages, in response to the supply of an electric current, the flow rate through said first exhaust passage is greater than that through said second exhaust passage.

* * * * *